US006071379A

United States Patent [19]

Wong Shing et al.

[11] Patent Number: 6,071,379

[45] Date of Patent: Jun. 6, 2000

[54] PAPERMAKING PROCESS UTILIZING HYDROPHILIC DISPERSION POLYMERS OF DIALLYLDIMETHYL AMMONIUM CHLORIDE AND ACRYLAMIDE AS RETENTION AND DRAINAGE AIDS

[75] Inventors: Jane B. Wong Shing, Aurora; John R. Hurlock, Hickory Hills; Chidambaram Maltesh; Ramasubramanyam Nagarajan, both of Naperville, all of Ill.

[73] Assignee: Nalco Chemical Company, Naperville, Ill.

[21] Appl. No.: 09/010,156

[22] Filed: Jan. 21, 1998

Related U.S. Application Data

[63] Continuation-in-part of application No. 08/719,283, Sep. 24, 1996, abandoned.

[51] Int. Cl.[7] ..... D21H 21/10

[52] U.S. Cl. ..... 162/168.2; 162/168.3; 162/164.6; 162/175; 162/183

[58] Field of Search ..... 162/168.2, 168.3, 162/164.6, 175, 183; 210/731, 723, 726, 727, 734, 735

[56] References Cited

U.S. PATENT DOCUMENTS

| | | |
|---|---|---|
| 4,151,202 | 4/1979 | Hunter et al. . |
| 4,388,150 | 6/1983 | Sunden et al. . |
| 4,753,710 | 6/1988 | Langley et al. . |
| 4,913,775 | 4/1990 | Langley et al. . |
| 4,929,655 | 5/1990 | Takeda et al. . |
| 5,006,590 | 4/1991 | Takeda et al. . |
| 5,098,520 | 3/1992 | Begala . |
| 5,185,062 | 2/1993 | Begala . |
| 5,254,221 | 10/1993 | Lowry et al. . |
| 5,466,338 | 11/1995 | Pearson . |
| 5,587,415 | 12/1996 | Takeda . |

*Primary Examiner*—P Chin

*Attorney, Agent, or Firm*—Michael B. Martin; Kelly L. Cummings; Thomas M. Breininger

[57] ABSTRACT

A method for improving retention and drainage performance in a papermaking process is disclosed. The method comprises forming an aqueous cellulosic papermaking slurry, adding an effective amount of a hydrophilic dispersion polymer to the slurry, draining the slurry to form a sheet and drying the sheet. The hydrophilic dispersion polymer is preferably a copolymer of diallyldimethyl ammonium chloride and acrylamide.

14 Claims, No Drawings

PAPERMAKING PROCESS UTILIZING HYDROPHILIC DISPERSION POLYMERS OF DIALLYLDIMETHYL AMMONIUM CHLORIDE AND ACRYLAMIDE AS RETENTION AND DRAINAGE AIDS

This application is a continuation-in-part of U.S. Ser. No. 08/719,283, filed Sep. 24, 1996, by Jane B. Wong Shing and John R. Hurlock entitled "Hydrophilic Dispersion Polymers for Paper Applications" now abandoned.

FIELD OF THE INVENTION

This invention relates generally to the field of papermaking and, more particularly, to an improved papermaking process utilizing hydrophilic dispersion copolymers of diallyl-N,N-disubstituted ammonium halide and (meth) acrylamide as retention and drainage aids.

BACKGROUND OF THE INVENTION

In the manufacture of paper, an aqueous cellulosic suspension or slurry is formed into a paper sheet. The cellulosic slurry is generally diluted to a consistency (percent dry weight of solids in the slurry) of less than 1 percent, and often below 0.5 percent, ahead of the paper machine, while the finished sheet must have less than 6 weight percent water. Hence, the dewatering aspects of papermaking are extremely important to the efficiency and cost of the manufacture.

The least costly dewatering method is drainage, and thereafter more expensive methods are used, including vacuum pressing, felt blanket blotting and pressing, evaporation and the like, and any combination of such methods. Because drainage is both the first dewatering method employed and the least expensive, improvements in the efficiency of drainage will decrease the amount of water required to be removed by other methods and improve the overall efficiency of dewatering, thereby reducing the cost thereof.

Another aspect of papermaking that is extremely important to the efficiency and cost of manufacture is the retention of furnish components on and within the fiber mat being formed during papermaking. A papermaking furnish contains particles that range in size from about the 2 to 3 millimeter size of cellulosic fibers to fillers measuring only a few microns. Within this range are cellulosic fines, mineral fillers (employed to increase opacity, brightness and other paper characteristics) and other small particles that generally, without the inclusion of one or more retention aids, would pass through the spaces (pores) between the cellulosic fibers in the fiber mat being formed.

One method of improving the retention of cellulosic fines, mineral fillers and other furnish components on the fiber mat is the use of a coagulant/flocculant system, which is added ahead of the paper machine. In such a system, a coagulant such as a low molecular weight cationic synthetic polymer or a cationic starch is first added to the furnish. The coagulant generally reduces the negative surface charges present on the particles in the furnish, particularly cellulosic fines and mineral fillers, and thereby agglomerates such particles. The coagulant is followed by the addition of a flocculent. The flocculant is generally a high molecular weight cationic or anionic synthetic polymer which bridges the particles and/or the agglomerates from one surface to another, thereby binding the particles into large agglomerates. The presence of such large agglomerates in the furnish increases retention. The agglomerates are filtered out of the water onto the fiber web, where unagglomerated particles would otherwise generally pass.

While a flocculated agglomerate generally does not interfere with the drainage of the fiber mat to the extent that would occur if the furnish were gelled or contained gelatinous material, when such flocs are filtered by the fiber web the pores thereof are reduced, thus reducing drainage efficiency. Hence, the retention is increased at the expense of a decrease in drainage.

Systems, such as those described in U.S. Pat. Nos. 4,753,710 and 4,913,775, the disclosures of which are incorporated herein by reference, have been employed to provide an improved combination of retention and dewatering. Briefly, these patents call for adding to the aqueous cellulosic papermaking suspension first a high molecular weight linear cationic polymer before shearing the suspension, followed by the addition of bentonite after shearing. The shearing is generally provided by one or more of the cleaning, mixing and pumping stages of the papermaking process. The shearing breaks down the large flocs formed by the high molecular weight polymer into microflocs, and further agglomeration then ensues with the addition of the bentonite clay particles.

Another system, disclosed in U.S. Pat. No. 4,388,150, uses the combination of cationic starch followed by colloidal silica to increase the amount of material retained on the web by charge neutralization and adsorption of smaller agglomerates.

U.S. Pat. Nos. 5,098,520 and 5,185,062, the disclosures of which are incorporated herein, describe methods of improving dewatering in a papermaking process.

Despite these prior systems, there is still a need for new processes utilizing hydrophilic dispersion polymers to improve retention and drainage performance, especially without the unwanted addition of oils and surfactants which are contained in the conventional latex polymers. As used herein, "latex" is defined to mean an inverse water-in-oil emulsion polymer. There is also a need for dispersion polymers which do not require an inverter system and can be introduced to the papermaking process using simple feeding equipment.

SUMMARY OF THE INVENTION

The method of the invention calls for forming an aqueous cellulosic papermaking slurry, adding an effective amount of a hydrophilic dispersion polymer to the slurry, draining the slurry to form a sheet and drying the sheet. The hydrophilic dispersion polymer comprises:

i. a cationic monomer diallyl-N,N-disubstituted ammonium halide wherein the substituents of said disubstituted ammonium halide are selected from the group consisting of $C_1$–$C_{20}$ alkyl groups, aryl groups, alkylaryl groups and arylalkyl groups and ii. a second monomer of the formula

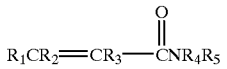

wherein $R_1$ and $R_2$ are selected from the group consisting of hydrogen, $C_1$–$C_{10}$ alkyl groups, aryl groups and alkylaryl groups; $R_3$ is selected from the group consisting of hydrogen and methyl groups and $R_4$ and $R_5$ are selected from the group consisting of $C_1$–$C_{10}$ straight chain or branched alkylene groups and hydrogen, in an aqueous solution of a polyvalent anionic salt wherein said polymerization is carried out in the presence of a dispersant.

This method improves retention and drainage performance without the unwanted addition of oils and surfactants. Moreover, the hydrophilic dispersion polymers utilized in the present invention do not require an inverter system and can be introduced to the papermaking process using simple feeding equipment.

DETAILED DESCRIPTION OF THE INVENTION

The present invention is directed to a method for improving retention and drainage performance in a papermaking process which comprises forming an aqueous cellulosic papermaking slurry, adding a hydrophilic dispersion polymer to the slurry, draining the slurry to form a sheet and then drying the sheet.

The hydrophilic dispersion polymer of the invention is a copolymer of diallyl-N,N-disubstituted ammonium halide cationic monomer and (meth)acrylamide. A preferred copolymer is formed from diallyldimethyl ammonium chloride (DADMAC) and acrylamide (AcAm). It has been found that the polymer described above confers advantages for use in a papermaking process. Specifically, the hydrophilic dispersion polymers of the invention show improved or equal activity with respect to retention and drainage performance without the unwanted addition of oils and surfactants as compared to conventional cationic latex polymers. Additionally, these polymers require no inverter system and can be introduced to the papermaking process using simple feeding equipment.

Another advantage concerns the mode of addition of the dispersion polymers. In most cases, conventional water-soluble polymers are now commercially available in a powder form. Prior to use, the polymeric powder must be dissolved in an aqueous medium for actual application. The polymer swells in aqueous medium, and the dispersed particles flocculate. It is typically very difficult to dissolve the conventional polymers in an aqueous medium. By contrast, the dispersion polymers of this invention, by their nature, avoid dissolution-related problems.

Furthermore, the dispersion copolymers formed from DADMAC and AcAm have the advantageous flexibility in that they may be used either as the sole polymeric treatment, or as a component in a conventional dual polymer program which requires both a conventional coagulant and a flocculant.

The dispersion copolymers of the present invention, if required in the form of an aqueous solution resulting from dilution with water, can be advantageously used in a number of technological fields as flocculating agents, thickeners, soil conditioners, adhesives, food additives, dispersants, detergents, additives for medicines or cosmetics, among others.

The Monomers

Example 1 outlines the process for preparing the copolymer at various ratios of the monomer components in the range of from about 1:99 to about 99:1 of acrylamide type monomer to diallyl-N,N-disubstituted ammonium halide. Each of the two types of monomers utilized to form the dispersion polymers of this invention will be described below in greater detail.

As concerns the diallyl-N,N-disubstituted ammonium halide, the di-substitutents of the monomer may be $C_1$–$C_{20}$ alkyl groups, aryl groups, alkylaryl groups or arylalkyl groups. Moreover, each of the di-substituents can be a different group. For example, one intended halide is N-methyl-N-ethyl-N,N-diallyl ammonium chloride.

A specific example of one applicable halide is DADMAC. Preferably, the amount of DADMAC present in the copolymer is from about 5 mole percent to about 30 mole percent. Diallyl-N,N-disubstituted ammonium halides, especially DADMAC are well-known and commercially available from a variety of sources. In addition to chloride, the counterion may also be bromide, sulfate, phosphate, monohydrogen phosphate and nitrate, among others. One method for the preparation of DADMAC is detailed in U.S. Pat. No. 4,151,202, the disclosure of which is incorporated herein by reference.

As concerns the acrylamide-type monomers, substituted (meth)acrylamide monomers may have either straight chain or branched alkyl groups. Applicable monomers include, but are not limited to, ethyl hexyl (meth)acrylamide, diethylaminopropyl (meth)acrylamide, dimethylaminohydroxypropyl (meth)acrylamide, N-isopropyl (meth)acrylamide, N-tert-butyl (meth)acrylamide, $C_1$–$C_{10}$ N-alkyl acrylamide, $C_1$–$C_{10}$ N-alkyl methacrylamide, N-aryl acrylamide, N-aryl methacrylamide, N-arylalkyl acrylamide, N-isopropyl (meth)acrylamide, N,N-dimethylacrylamide (meth) acrylamide, $C_1$–$C_{10}$ N,N-dialkyl acrylamide, $C_1$–$C_{10}$ N,N-dialkyl methacrylamide, N,N-diaryl acrylamide, N,N-diaryl methacrylamide, N,N-diallylalkyl acrylamide, and N,N-diarylalkyl methacrylamide. As used herein, the term "arylalkyl" is meant to encompass benzyl groups and phenethyl groups. "Pendant amine" refers to an $NH_2$ group which is attached to the main polymer chain.

The Polyvalent Anionic Salts

A polyvalent anionic salt is incorporated in an aqueous solution. According to the present invention, the polyvalent anionic salt is suitably a sulfate, a phosphate or a mixture thereof. Preferable salts include ammonium sulfate, sodium sulfate, magnesium sulfate, aluminum sulfate, ammonium hydrogen phosphate, sodium hydrogen phosphate and potassium hydrogen phosphate. In the present invention, these salts may be each used as an aqueous solution thereof having a concentration of 15% or above.

The Dispersant

A dispersant polymer is present in the aqueous anionic salt solution in which the polymerization of the above monomers occurs. The dispersant polymer is a water-soluble high molecular weight cationic polymer and is preferably soluble in the above-mentioned aqueous salt solution. It is preferred that the dispersant polymer be used in an amount of from about 1 to 10% by weight based on the total weight of the hydrophilic dispersion polymer.

The dispersant polymer is composed of 20 mole % or more of cationic monomer units of diallyl disubstituted ammonium halide or N,N-dialkyl-aminoethyl(meth) acrylates and their quaternary salts. Preferably, the residual mole % is AcAm or (meth)AcAm. The performance of the dispersant is not greatly affected by molecular weight. However, the molecular weight of the dispersant is preferably in the range of about 10,000 to 10,000,000. Preferred dispersants include homopolymers of diallyldimethyl ammonium chloride, dimethylaminoethylacrylate methyl chloride quaternary salt and dimethylaminoethylmethacrylate methyl chloride quaternary salt.

According to one embodiment of the invention, a multifunctional alcohol such as glycerin or polyethylene glycol is coexistent in the polymerization system. The deposition of the fine particles is smoothly carried out in the presence of these alcohols. Moreover, polysaccharides such as starch, dextran, carbomethoxy cellulose and pullulan, among others, can also be used as stabilizers either solely, or in conjunction with other organic cationic flocculants.

The Dispersion Polymers

For the polymerizations, a usual water-soluble radical-forming agent can be employed, but preferably water-soluble azo compounds such as 2,2'-azobis(2-amidinopropane) hydrochloride and 2,2'-azobis(N,N'-dimethyleneisobutylamine) hydrochloride are used.

According to one embodiment of the invention, a seed polymer is added before the beginning of the polymerization of the above monomers for the purpose of obtaining a fine dispersion. The seed polymer is a water-soluble cationic polymer insoluble in the aqueous solution of the polyvalent anion salt. The seed polymer is preferably a polymer prepared from the above monomer mixture by the process described herein. Nevertheless, the monomer composition of the seed polymer need not always be equal to that of the water-soluble cationic polymer formed during polymerization. However, like the water-soluble polymer formed during polymerization, the seed polymer should contain at least 5 mole percent of cationic monomer units of diallyldimethyl ammonium halide. According to one embodiment of the invention, the seed polymer used in one polymerization reaction is the water-soluble polymer prepared in a previous reaction which used the same monomer mixture.

The Method

An aqueous cellulosic slurry is first formed by any conventional means generally known to those skilled in the art. A hydrophilic dispersion polymer is next added to the slurry.

The hydrophilic dispersion polymer is formed by the polymerization of i. a cationic monomer diallyl-N,N-disubstituted ammonium halide wherein the substituents of said disubstituted ammonium halide are selected from the group consisting of $C_1$–$C_{20}$ alkyl groups, aryl groups, alkylaryl groups and arylalkyl groups and ii. a second monomer of the formula

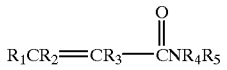

wherein $R_1$ and $R_2$ are selected from the group consisting of hydrogen, $C_1$–$C_{10}$ alkyl groups, aryl groups and alkylaryl groups; $R_3$ is selected from the group consisting of hydrogen and methyl groups and $R_4$ and $R_5$ are selected from the group consisting of $C_1$–$C_{10}$ straight chain or branched alkylene groups and hydrogen, in an aqueous solution of a polyvalent anionic salt wherein said polymerization is carried out in the presence of a dispersant.

The cellulosic papermaking slurry is next drained to form a sheet and then dried. The steps of draining and drying may be carried out in any conventional manner generally known to those skilled in the art.

The cationic monomer may be DADMAC and the second monomer may be AcAm. The hydrophilic dispersion polymer may have a cationic charge of from about 1 ol % to about 50 mol %.

Additionally, conventional coagulants, conventional flocculants, alum, cationic starch or a combination thereof may also be utilized as adjuncts with the dispersion polymers, though it must be emphasized that the dispersion polymer does not require any adjunct for effective retention and drainage activity.

Furthermore, the range of intrinsic viscosities for the hydrophilic dispersion polymers of the invention is from about 0.5 to about 10 dl/g, preferably from about 1.5 to about 8.5 dl/g and most preferably from about 2.5 to about 7.5 dl/g. Depending upon the conditions at the particular mill, the preferred dose is from about 0.05 to about 5.0 pounds of active per ton of slurry solids.

EXAMPLES

The following examples are intended to be illustrative of the present invention and to teach one of ordinary skill how to make and use the invention. These examples are not intended to limit the invention or its protection in any way.

Example 1

A dispersion copolymer of 30% mol diallyldimethyl ammonium chloride and acrylamide was synthesized in the following manner. 25.667 grams of a 49.0% solution of acrylamide (0.1769 moles), 161.29 grams of a 62.0% solution of DADMAC (0.6192 moles), 200 grams of ammonium sulfate, 40 grams of sodium sulfate, 303.85 grams of deionized water, 0.38 grams of sodium formate, 45 grams of a 20% solution of poly(DMAEA.MCQ) (dimethylaminoethylacrylate methyl chloride quaternary salt, IV=2.0 dl/gm) and 0.2 grams of EDTA were added to a two liter resin reactor equipped with a stirrer, temperature controller, and water cooled condenser. The mixture was heated to 48° C. and 2.50 grams of a 4% solution of 2,2'-azobis(2-amidinopropane) dihydrochloride and 2.50 grams of a 4% solution of 2,2'-azobis(N,N-dimethylene isobutyramidine) dihydrochloride were added. The resulting solution was sparged with 1000 cc/min of nitrogen. After 15 minutes, polymerization began and the solution became viscous. Over the next 4 hours, the temperature was maintained at 50° C. and a solution containing 178.42 grams of 49.0% AcAm (1.230 moles) and 0.2 grams of EDTA was pumped into the reactor using a syringe pump. The resulting polymer dispersion had a Brookfield viscosity of 4200 cps. The dispersion was then further reacted for 2.5 hours at a temperature of 55° C. The resulting polymer dispersion had a Brookfield viscosity of 3300 cps. 10 grams of 99% adipic acid, 10 grams of ammonium sulfate and 12.5 grams of a 60% aqueous solution of ammonium thiosulfate were added to the polymer dispersion. The resulting dispersion had a Brookfield viscosity of 1312.5 cps and contained 20% of a 50 weight percent copolymer of DADMAC and AcAm with an intrinsic viscosity of 6.32 dl/gm in 1.0 molar $NaNO_3$.

The polymers used in this invention and their respective descriptions are summarized in Table I.

TABLE I

| Dispersion I [1] Other Polymers [2] | 30/70 mole % DADMAC/AcAm | RSV[4] 4.7 dl/g |
|---|---|---|
| Polymer I [2] | 30/70 mole % DADMAC/ AcAm Latex | RSV 5.0 dl/g |
| Polymer J [2] | 10/90 mole % DMAEA.MCQ/ AcAm Latex | RSV 15.2 dl/g |
| Polymer K [2] | 1/99 mole % DMAEA.MCQ/ AcAm Latex | RSV 27.8 dl/g |
| Polymer L [2] | 5/95 mole % DMAEA.MCQ/ AcAm Latex | RSV 24.8 dl/g |
| Polymer M [2] | 10/90 mole % DMAEA.MCQ/ AcAm Latex | RSV 22.5 dl/g |
| Polymer N [2] | 10/90 mole % DMAEA.MCQ/ AcAm Dispersion | RSV 18.6 dl/g |
| Polymer O [2] | 10/90 mole % DMAEA.BCQ/ AcAm Dispersion | RSV 18.3 dl/g |
| Polymer P [2] | 30/70 mole % DMAEA.MCQ/ AcAm Latex | RSV 17.5 dl/g |
| Polymer Q [3] | 10/90 mole % DMAEA.MCQ/ AcAm Dry polymer | RSV 15.0 dl/g |

[1] synthesized according to Example 1 (IV = 4.4 dl/g)
[2] conventional treatment, available from Nalco Chemical Company of Naperville, IL
[3] dry polymer available from Chemtall of Riceboro, GA
[4] RSV (Reduced Specific Viscosity) is measured at 0.045% in 1.0 molar sodium nitrate.

Example 2

To determine the activity of the hydrophilic dispersion polymers synthesized according to Example 1, the following procedure was utilized. The vacuum drainage tester (VDT) was used to evaluate drainage performance. Thin stock for the VDT tests was obtained from a Southern linerboard papermill at a sampling point just before the base sheet headbox. Because there were no retention/drainage aids being used on the paper machine, the thin stock was tested as is.

The furnish was treated in a Britt jar stirring at 1000 rpm. The VDT tests were conducted by the normal procedure of transferring the treated furnish to the VDT chamber, and then filtering under 15 in. Hg (7.84 psi) vacuum through the Filpaco #716 paper. The testing conditions are given in Table II. The drainage rates are expressed in terms of the time taken to collect 100 ml filtrate volumes.

Cationic polymer programs showed activity with the base sheet furnish relative to an untreated sample (Blank). Table III shows the VDT drainage data for polymers listed in Table I. A lower drainage time (for a constant volume of 100 ml) indicates a higher drainage rate. Therefore, the higher the drainage rate, the more effective the treatment. The results in Table III demonstrate that the hydrophilic DADMAC/AcAm dispersion polymer (Dispersion I) is superior to conventional treatments. Moreover, the drainage performance of Dispersion I was better than its latex analog, Polymer I. In addition, the turbidity of the filtrate obtained with Dispersion I was visibly clearer than the other polymers tested, implying better retention.

TABLE II

Testing Conditions for Polymer Screening at Southern Papermill with Unbleached Linerboard Furnish

| | |
|---|---|
| Polymer makedown | 1 wt % product 5–7 minutes cage stirrer, diluted to 0.1 wt % product, both with tap water |
| Polymer Dosage | 1 ml = 0.5 lb/t |
| Britt Jar | PRM DDJ vaned (for furnish preparation) |
| Stirrer speed | 1000 rpm |
| Timing Sequence | Single and dual polymer programs start stirrer<br>t = 0 sec add furnish and coagulant<br>t = 10 sec add flocculant<br>t = 20 sec stop transfer to VDT |
| Vacuum Drainage Tester | Standard procedure using Filpaco# 716 filter medium and 15 in. Hg (7.84 psi) vacuum. Record time taken to collect 100 ml filtrate |

TABLE III

VDT Drainage Performance of Cationic Polymer Programs at Southern Papermill with Unbleached Linerboard Furnish

| Program | Dosage 1.0 lb/t Drainage Time for 100 ml (sec) | Dosage 2.0 lb/t Drainage Time for 100 ml (sec) |
|---|---|---|
| Blank (no polymer) | 40.47 | 40.47 |
| Dispersion I | 19.78 | 16.78 |
| Polymer I | 24.87 | 18.18 |
| Polymer J | 28.59 | 19.46 |
| Polymer K | 26.56 | 18.58 |
| Polymer L | 31.25 | 15.21 |
| Polymer M | 36.65 | 19.87 |
| Polymer N | 33.40 | 26.50 |
| Polymer O | 39.59 | 31.37 |
| Polymer P | 38.37 | 28.59 |

Example 3

A series of VDT drainage experiments were performed using the hydrophilic dispersion DADMAC/AcAm polymer (Dispersion I) with thin stock obtained from a Midwestern boxboard papermill. The furnish was treated in a Britt jar stirring at 1000 rpm. The VDT tests were conducted by the normal procedure of transferring the treated furnish to the VDT chamber, and then filtering under 15 in. Hg (7.84 psi) vacuum through the Filpaco #716 paper. The testing conditions are shown in Table IV.

The results are summarized in Table V. The drainage rates are expressed in terms of the time taken to collect 400 ml filtrate volumes. A lower drainage time to collect a constant volume of 400 ml indicates better performance. The data in Table V show the flexibility of the hydrophilic dispersion polymer in that it can be used either as a sole polymeric treatment (flocculant) or as a coagulant in a dual program with conventional flocculants (Polymer Q, Polymer N).

TABLE IV

Testing Conditions for Polymer Screening with Boxboard Furnish from a Midwestern Papermill

| | |
|---|---|
| Polymer makedown | 1 wt % product with cage stirrer, diluted to 0.1 wt % product |
| Polymer Dosage | 1 ml = 0.25 lb/t |
| Britt Jar | PRM DDJ vaned (for furnish preparation) |
| Stirrer speed | 1000 rpm |
| Timing Sequence | Single and dual polymer programs<br>start stirrer<br>t = 0 sec add furnish and coagulant<br>t = 10 sec add flocculant<br>t = 20 sec stop transfer to VDT |
| Vacuum Drainage Tester | Standard procedure using Filpaco# 716 filter medium and 15 in. Hg (7.84 psi) vacuum. Record time taken to collect 400 ml filtrate |

TABLE V

VDT Drainage Performance of Cationic Polymer Programs with Boxboard Furnish from a Midwestern Papermill

| Program | Dosage lb/t | Drainage Time for 400 ml (sec) |
|---|---|---|
| Blank (no polymer) | — | 45.44 |
| Dispersion I | 0.25 | 26.71 |
| Polymer Q | 0.06 | 30.18 |
| Dispersion I/Polymer Q | 0.25/0.06 | 22.12 |
| Polymer Q | 0.13 | 25.68 |
| Dispersion I/Polymer Q | 0.25/0.13 | 20.15 |
| Polymer N | 0.06 | 21.18 |
| Dispersion I/Polymer N | 0.25/0.06 | 19.25 |

While the present invention is described above in connection with preferred or illustrative embodiments, these embodiments are not intended to be exhaustive or limiting of the invention. Rather, the invention is intended to cover all alternatives, modifications and equivalents included within its spirit and scope, as defined by the appended claims.

What is claimed is:

1. A method for improving retention and drainage performance in a papermaking process comprising the steps of:

a) forming an aqueous cellulosic papermaking slurry;

b) adding an effective amount of a hydrophilic dispersion polymer to the slurry wherein the hydrophilic dispersion polymer has a cationic charge of from about 1 mole percent to about 50 mole percent, an intrinsic viscosity of from about 2.5 to about 10 deciliters per gram and results from the polymerization of:

i. a cationic monomer diallyl-N,N-disubstituted ammonium halide wherein the substituents of said disubstituted ammonium halide are selected from the group consisting of $C_1$–$C_{20}$ alkyl groups, aryl groups, alkylaryl groups and arylalkyl groups and ii. a second monomer of the formula $$R_1CR_2{=}CR_3{-}\overset{\overset{\displaystyle O}{\|}}{C}NR_4R_5$$

wherein $R_1$ and $R_2$ are selected from the group consisting of hydrogen, $C_1$–$C_{10}$ alkyl groups, aryl groups and alkylaryl groups; $R_3$ is selected from the group consisting of hydrogen and methyl groups and $R_4$ and $R_5$ are selected from the group consisting of $C_1$–$C_{10}$ straight chain or branched alkylene groups and hydrogen, in an aqueous solution of a polyvalent anionic salt wherein said polymerization is carried out in the presence of a dispersant;

c) draining the slurry to form a sheet; and d) drying the sheet.

2. The method of claim 1 wherein the cationic monomer is diallyldimethyl ammonium chloride and the second monomer is acrylamide.

3. The method of claim 1 wherein the hydrophilic dispersion polymer has an intrinsic viscosity of from about 2.5 to about 8.5 deciliters per gram.

4. The method of claim 1 wherein the hydrophilic dispersion polymer has an intrinsic viscosity of from about 2.5 to about 7.5 deciliters per gram.

5. The method of claim 1 wherein the dispersion polymer is added in an amount of from about 0.05 to about 5.0 pounds of active per ton of slurry solids.

6. The method of claim 1 further comprising addition of a coagulant in step b).

7. The method of claim 1 further comprising the addition of a flocculant in step b).

8. The method of claim 1 further comprising the addition of alum in step b).

9. The method of claim 6 further comprising the addition of alum in step b).

10. The method of claim 7 further comprising the addition of alum in step b).

11. The method of claim 1 further comprising the addition of a cationic starch in step b).

12. The method of claim 6 further comprising the addition of a cationic starch in step b).

13. The method of claim 7 further comprising the addition of a cationic starch in step b).

14. The method of claim 1 wherein the cationic monomer is diallydimethyl ammonium chloride, the second monomer is acrylamide and the hydrophilic dispersion polymer has a cationic charge of about 30 mole percent and an intrinsic viscosity of about 6 deciliters per gram.

* * * * *